US007000419B1

(12) United States Patent
Ohmi et al.

(10) Patent No.: US 7,000,419 B1
(45) Date of Patent: Feb. 21, 2006

(54) HIGH-EFFICIENCY GAS TEMPERATURE/HUMIDITY CONTROLLING DEVICE AND CONTROLLING METHOD

(75) Inventors: Tadahiro Ohmi, 1-17-301 Komegabukuro 2-chome, Aoba-ku, Sendai-shi, Miyagi 980-0813 (JP); Yasuyuki Shirai, Miyagi (JP); Masaki Hirayama, Miyagi (JP); Hideo Hanaoka, Tokyo (JP); Takeshi Honma, Tokyo (JP); Hirokazu Suzuki, Tokyo (JP); Yoshio Yamazaki, Tokyo (JP); Yoshinori Ohkubo, Tokyo (JP)

(73) Assignees: Tadahiro Ohmi, Miyagi-Ken (JP); Hitachi Plant Engineering & Construction Co, LTD, Tokyo (JP)

( * ) Notice: Subject to any disclaimer, the term of this patent is extended or adjusted under 35 U.S.C. 154(b) by 422 days.

(21) Appl. No.: 10/070,579

(22) PCT Filed: Sep. 11, 2000

(86) PCT No.: PCT/JP00/06191

§ 371 (c)(1),
(2), (4) Date: Jun. 21, 2002

(87) PCT Pub. No.: WO01/18455

PCT Pub. Date: Mar. 15, 2001

(30) Foreign Application Priority Data

Sep. 9, 1999 (JP) ..... 11/255964

(51) Int. Cl.
*F24F 3/16* (2006.01)
*F25D 2/10* (2006.01)

(52) U.S. Cl. ..... 62/282; 62/78

(58) Field of Classification Search ..... 62/282, 62/78, 305, 279, 280
See application file for complete search history.

(56) References Cited

U.S. PATENT DOCUMENTS 2,776,554 A * 1/1957 Pigman ..... 62/280
4,067,206 A * 1/1978 Smith ..... 62/280

(Continued)

FOREIGN PATENT DOCUMENTS

JP 55-177173 12/1980

(Continued)

*Primary Examiner*—Melvin Jones

(74) *Attorney, Agent, or Firm*—Randall J. Knuth

(57) ABSTRACT

The present invention has an object to comprise an apparatus for high efficiency gas temperature and humidity adjustment and an adjustment method allowing to elevate the heat exchange efficiency of a cooling coil, reduce the cooling water quantity, lower also the pipe arrangement diameter and water supply pump power, making possible to cut the initial cost and running cost of the air-conditioning system.

The apparatus for high efficiency gas temperature and humidity adjustment is characterized by that means for removing condensate water deposited on the cooling coil.

17 Claims, 8 Drawing Sheets

U.S. PATENT DOCUMENTS

| | | | | | |
|---|---|---|---|---|---|
| 4,393,653 | A | * | 7/1983 | Fischer | 60/511 |
| 4,427,495 | A | * | 1/1984 | Masero | 203/11 |
| 4,771,611 | A | * | 9/1988 | McNab | 62/311 |
| 4,973,529 | A | * | 11/1990 | Grasso et al. | 429/12 |
| 5,256,311 | A | * | 10/1993 | Rossi et al. | 210/750 |
| 5,317,882 | A | * | 6/1994 | Ritenour | 62/268 |
| 5,357,764 | A | * | 10/1994 | Dickman | 62/93 |
| 5,461,879 | A | * | 10/1995 | Bolton et al. | 62/280 |
| 6,308,108 | B1 | * | 11/2001 | Holstein et al. | 62/279 |

FOREIGN PATENT DOCUMENTS

| | | |
|---|---|---|
| JP | 56-117098 | 9/1981 |
| JP | 57-122272 | 7/1982 |
| JP | 59-60481 | 4/1984 |
| JP | 4-103521 | 9/1992 |
| JP | 5-118594 | 5/1993 |
| JP | 6-265291 | 9/1994 |
| JP | 8-14792 | 1/1996 |
| JP | 10-176897 | 6/1998 |
| JP | 10-213386 | 11/1998 |

* cited by examiner

HIGH-EFFICIENCY GAS TEMPERATURE/HUMIDITY CONTROLLING DEVICE AND CONTROLLING METHOD

FIELD OF THE INVENTION

The present invention concerns an apparatus for high efficiency gas temperature and humidity adjustment performing air-conditioning processes such as humidification, dehumidification, rise of temperature, cooling of a gas which is a processed product and an adjustment method of the same.

BACKGROUND ART

Energy saving equipment is strongly required for air conditioning installation of the future architectural structures. Especially, concerning the running cost of the clean room, the proportion that the electricity charges occupy attains the order of one third of the whole, and most of them concern the power consumed by the air-conditioning installation and process unit. Hence, it is essential for a low lost production to reduce the air-conditioning installation and process unit electric quantity.

The power consumption contributes largely to the operation of air-conditioning facilities. Therefore, the improvement of efficiency of an air-conditioner directly leads to the energy saving.

The enhancement of efficiency of the cooling coil which is one of components composing an air-conditioner leads to the increase of efficiency of the air-conditioner.

Condensate water deposits during the operation on the cooling coil of an air-conditioner in operation. The condensate water results in lowering the cooling effect of an air-conditioned gas. The decrease of efficiency by the fact that the heat-transfer coefficient of condensate water is lower than the heat-transfer coefficient of copper is prevented from removing condensate water deposited on the cooling coil.

The present invention has an object to provide an apparatus for high efficiency gas temperature and humidity adjustment and an adjustment method allowing to elevate the heat exchange efficiency of the cooling coil, lower the cooling water quantity, reduce the piping diameter and the conveying pump power and cut initial costs and running costs of an air-conditioning system.

DISCLOSURE OF THE INVENTION

The apparatus for high efficiency gas temperature and humidity adjustment of the present invention is characterized by that a means for removing condensate water deposited on the cooling coil is provided.

The high efficiency gas temperature and humidity adjustment method of the present invention is a gas temperature and humidity adjustment method for cooling a gas to be cooled by letting a cooling water flow in a cooling tube of an cooling coil and, at the same time, letting the gas to be cooled flow between cooling fins, wherein a deaeration water is used as the cooling water.

The high efficiency gas temperature and humidity adjustment method of the present invention is a gas temperature and humidity adjustment method for cooling a gas to be cooled by letting a cooling water flow in a cooling tube of an cooling coil and, at the same time, letting the gas to be cooled flow between cooling fins, wherein a hydrogen water is used as the cooling water.

The high efficiency gas temperature and humidity adjustment method of the present invention is a gas temperature and humidity adjustment method for cooling a gas to be cooled by letting a cooling water flow in a cooling tube of an cooling coil and, at the same time, letting the gas to be cooled between cooling fins, wherein the cooling is performed after or during the removal of condensate water from the cooling coil.

It should be appreciated that the compressed as is preferably a cooling gas. In the case of using such cooling gas, there is an advantage that the quantity of heat other than the quantity of heat that should primarily be submitted to a cooling treatment is unnecessary. As for the temperature of cooling gas, 23 to 15° C. is preferable for the reason that there is a difference between the pro-treatment temperature and the post-treatment temperature.

Also, it is preferable the surface of the cooling coil be a water repellent surface. For a surface to be water repellent, for instance, a PFA film may be applied to the surface of the cooling coil. Other than the PFA, for example, water-repellent material application and formation of water repellent film are preferable.

In addition, it is preferable to provide means capable of spreading again the condensed liquid. In the case of such composition, there is an advantage that unnecessary heat exchange is not performed, because the condensed liquid temperature and the heat exchanger temperature are equal. As the means capable of spreading again the condensed liquid, for example, it may be configured to draw condensate water by a small pump from a condensate water pan in the air-conditioner, and to spread again from the heat exchanger upper part.

Furthermore, it is preferable to apply an alumite treatment film to the surface of the cooling coil. The adoption of such composition improves the heat-transfer coefficient by heat radiation from the surface thereof to the gas, improving the cooling efficiency.

DESCRIPTION OF SYMBOLS

Figure 1:
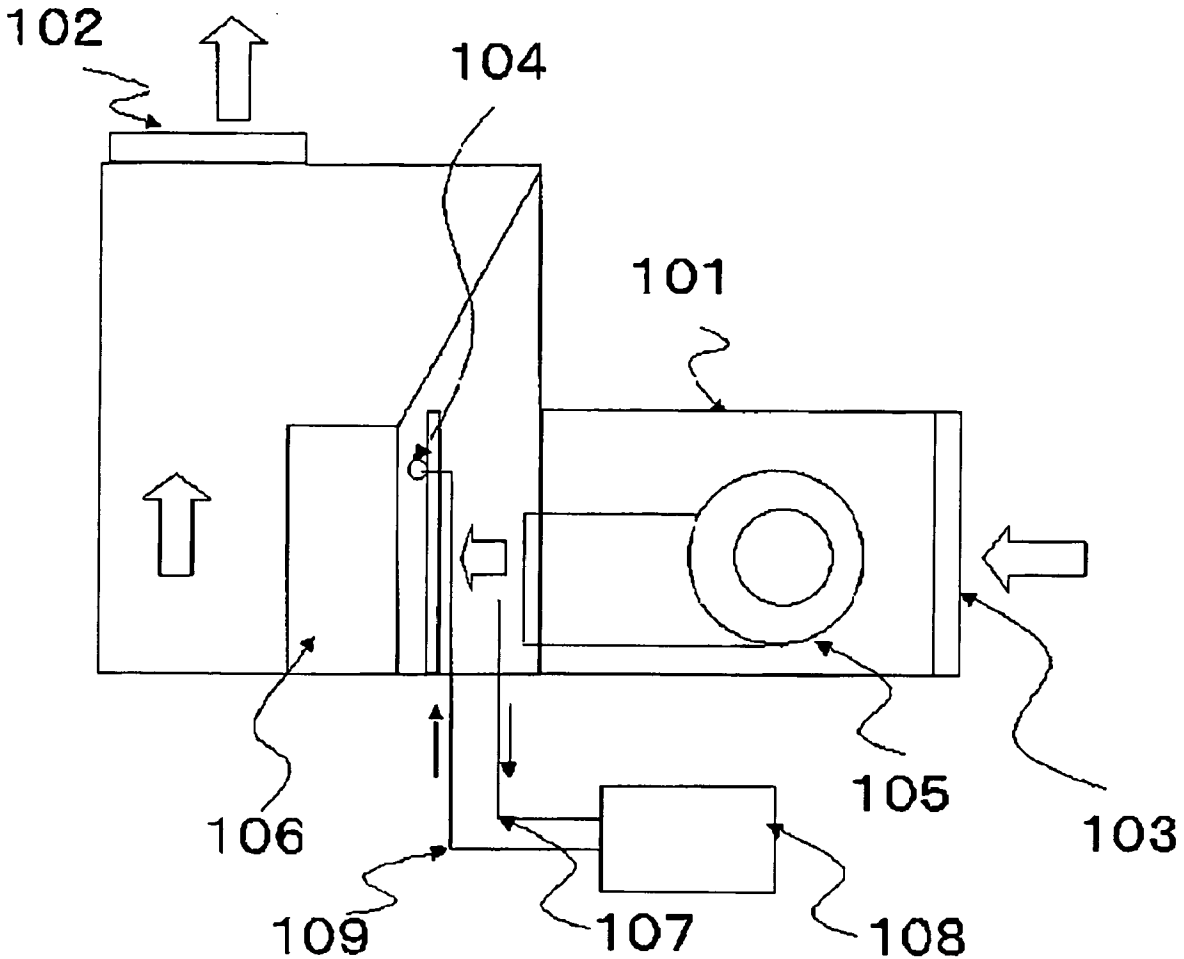
FIG. 1 is a schematic diagram showing an apparatus for high efficiency gas temperature and humidity adjustment according to the present invention.

| | |
|---|---|
| 101 | Air-conditioner main body |
| 102 | Gas exhaust port |
| 103 | Gas intake |
| 104 | Condensate water removal apparatus |
| 105 | Ventilator fan |
| 106 | Cooling coil |
| 107 | Gas sampling pipe arrangement |
| 108 | Compressor |
| 109 | Compressed gas supply pipe arrangement |
| 201 | Cooling coil main body |
| 202 | Cooling tube 203 Cooling tube |
| 204 | Cooling water return pipe arrangement |
| 205 | Cooling water supply pipe arrangement |
| 206 | Cooling fin |
| 207 | Enter side flow of gas to be cooled |
| 208 | Exit side flow of gas to be cooled |
| 301 | Compressed gas pipe arrangement connection port |
| 302 | Air-conditioner casing |
| 303 | Compressed gas header |
| 304 | Cooling coil |
| 305 | Supply gas before cooling |
| 306 | Electric motor for driving |
| 307 | Compressed gas tube |
| 308 | Guide for movement of compressed gas header |
| 309 | Supply gas after cooling |
| 310 | Header stop position |
| 311 | Compressed gas supply nozzle |
| 401 | Air-conditioner casing |
| 402 | Guide for movement of compressed gas header |
| 403 | Compressed gas header |
| 404 | Compressed gas pipe arrangement connection port |
| 405 | Electric motor for driving |
| 406 | Compressed gas tube |
| 407 | Cooling coil |
| 408 | Compressed gas supply nozzle |
| 501 | Aluminum fin |
| 502 | Compressed gas header |
| 503 | Compressed gas nozzle |
| 504 | Cooling coil tube |
| 505 | Compressed gas nozzle angle |
| 506 | Cooling tube alignment angle |
| 601 | Rotary brush track |
| 602 | Rotary brush |
| 603 | Rotating shaft |
| 604 | Heat exchanger |
| 605 | One end flat brush |
| 606 | Both ends flat brush |
| 607 | Heat exchanger |

BEST MODE FOR CARRYING OUT THE INVENTION

Now, embodiments of the present invention shall be described based on FIG. 1 to FIG. 6.

In an apparatus for high efficiency gas temperature and humidity adjustment, a cooling coil is used to cool a gas to be adjusted and to adjust the temperature and humidity. Ordinarily, the coil is supplied with a cooling water of around 7° C., used for lowering the temperature of a gas to be adjusted in contact therewith taking profit of the heat source.

The heat exchange efficiency that lowers under condition where a water film deposits on the cooling coil is shown by an example described below. Suppose cooling heat quantity by q, heat transmission coefficient of enthalpy reference Kw, coil surface area S, logarithmic mean temperature difference difference MED, internal and external area ratio R, heat conductivity of pipe inner surface äw, scale coefficient of pipe inner surface $r_1$, contact thermal resistance between copper pipe, aluminum fin and pipe $r_2$, proportion constant bw, mass-transfer coefficient on fin surface kf, and fin efficiency ϕw, a relation:

$$q=Kw\cdot S\cdot MED$$

$$1/Kw=R/äw+R(r_1+r_2)bw+1/[kf\{\phi w+(1/R)\}]$$

is found.

Applying general values to the aforementioned formula, the cooling heat quantity becomes about 642 cal/h.

The cooling heat quantity q' at the time when condensate water deposits on the cooling coil in layer, becomes as follows. The compensated value of internal and external area ratio R be R', and heat transmission coefficient Kw' in the case of deposit of water layer of d in depth on the coil:

$$1/Kw'=R\ áw/zw+R\ (r_1+r_2)bw+R'\cdot bw\cdot d/ü+1/[kf\{öw+(1/R)\}]=1/Kw+ë/ë$$

Suppose the water film depth be 1.0 mm, the cooling heat quantity q' becomes about 430 kcal/h.

According to the foregoing, if 1.0 mm of water film deposits on the cooling coil, the heat exchange rates by the coil results in a decrease of about 33%.

FIG. 1 shows an apparatus for high efficiency gas temperature and humidity adjustment according to an embodiment of the present invention.

The apparatus is configured to blow off by force condensate water deposited on the cooling coil by compressed gas or a brush (rotational brush or flat brush). 101 is a air-conditioner main body, for taking a gas from a gas intake 103 in the air-conditioner main body 101, and discharging temperature and humidity adjusted gas from a gas exit 102 by a fan 105 for transferring the gas. A cooling coil 106 is installed in a passage of gas through the air-conditioner main body 101. A condensate water removal apparatus 104 is installed upstream the cooling coil 106. In the case of using compressed gas, a part of gas taken in by a fan coil is taken in a compressor 108 by a sampling pipe arrangement 107 to produce a compressed air. A compressed air supply header 104 is supplied with the produced compressed air by a compressed air supply pipe arrangement 109.

The blowing pressure of compressed gas to the cooling coil 106 is preferably 2 to 10 kgf/cm$^2$, and more preferably 3 to 5 kgf/cm$^2$. If the pressure is less than 2 kgf/cm$^2$, sometimes condensate water can not be removed sufficiently. On the contrary, if it is excessively higher than 10 kgf/cm$^2$, the performance of gas temperature and humidity may be affected.

In the foregoing description, a case of using a cooled gas to be cooled of which temperature and humidity are adjusted by the cooling coil 106 as compressed gas has been explained; however a compressed air may be introduced from outside and in the case, it is preferable to adjust the temperature and humidity outside.

Figure 2:
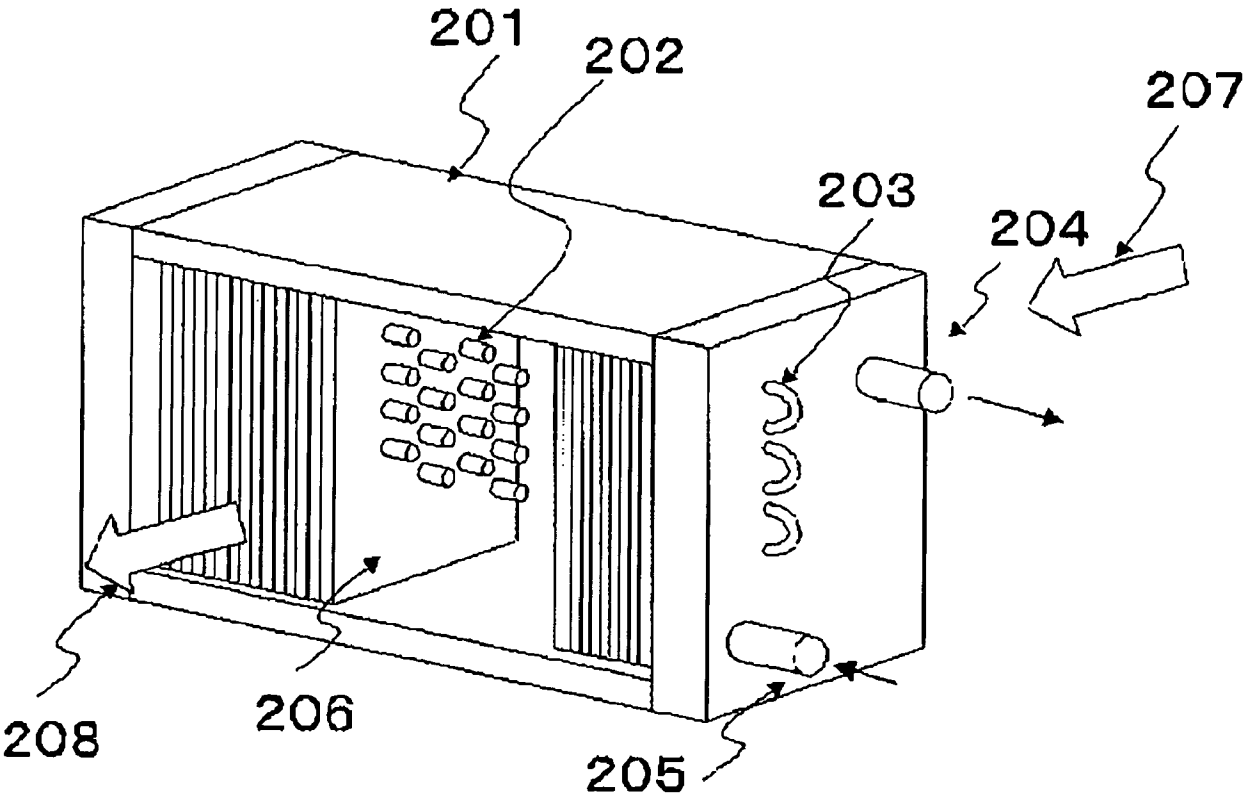
FIG. 2 is a schematic perspective view of a cooling coil body according to the present invention.

FIG. 2 is a schematic view of the cooling coil.

The cooling coil is composed by arranging a plurality of cooling fins 206 and cooling water tubes 202, 203 in the cooling coil main body 201. One end of the cooling water tube communicates with a cooling water intake 205 and the other end communicates with a cooling water exit 204.

A gas to be cooled 207 passes through between cooling fins 206 each other in the cooling coil main body 201, a cooled gas to be cooled 208 comes out. Cooling water is supplied from the cooling water intake 205, and discharged from the cooling water outlet 204. The cooling water passes through the cooling water tube 202, 203. In order to enhance the cooling efficiency, the cooling fin 206 is installed in a perpendicular direction in respect to the cooling tube 202, 203.

Figure 3:
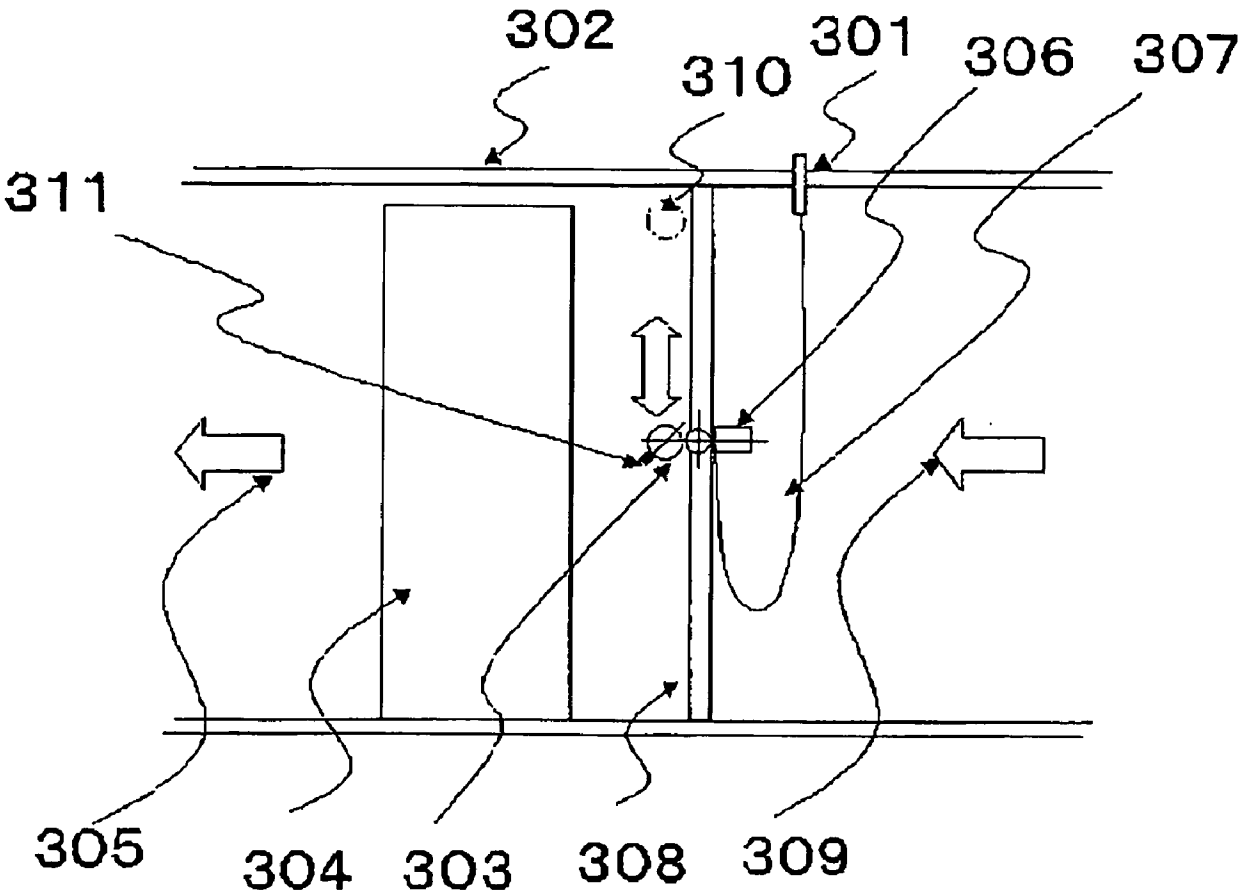
FIG. 3 is a schematic view of an apparatus for cooling coil condensate water removal according to the present invention.
Figure 4:
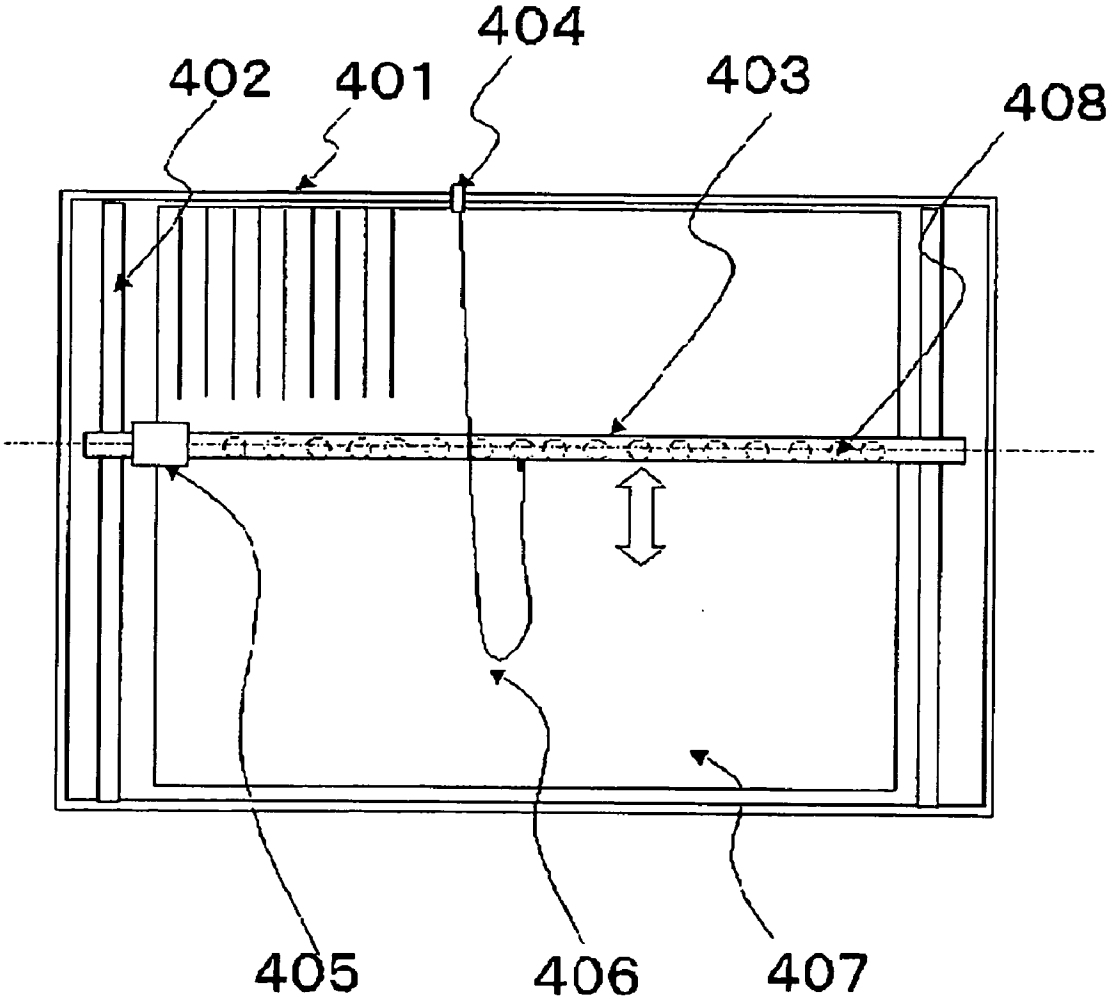
FIG. 4 is a schematic view of an apparatus for cooling coil condensate water removal according to the present invention.

FIGS. 3 and 4 shows respectively a side view and a front view of the compressed gas supply apparatus. The gas to be cooled enters from the drawing right side 309, and flows in the direction of the drawing left side 305. Compressed gas necessary for removing condensate water deposited on the cooling coil of 304 or 407 by the compressed gas supply apparatus is supplied, and condensate water is removed by force from the coil and fin surface by vertical movement the compressed gas supply nozzle 311 or 408, using an electric motor for vertical displacement 306 or 405, along a guide for compressed air header displacement of 308 or 402. In the example, the compressed air header 308, 402 reciprocates up and down continuously, and the stop position is supposed to be cooling coil upstream side front. For instance, a gas of a pressure about 5.0 kg/cm$^2$ is sprayed perpendicularly to the cooling coil, to drop down removed condensate water into a drain pan. 303 or 403 is a compressed gas header, composed of stainless pipe arrangement or the like and provided with discharge nozzles 311 or 408 of compressed gas equidistantly, 308 and 402 is a nozzle up and down guide displacement guide, and the guide is fixed to the air-conditioner main body 302 or 401. Also, the guide 308 or 402 is installed at the right and left of a cooling coil, and is placed at a position not interfering with the gas flow. The compressed gas is supplied from the compressed gas pipe arrangement nozzle 301 or 404 and delivered to the compressed gas nozzle through a flexible tube 307 or 406.

Figure 5:
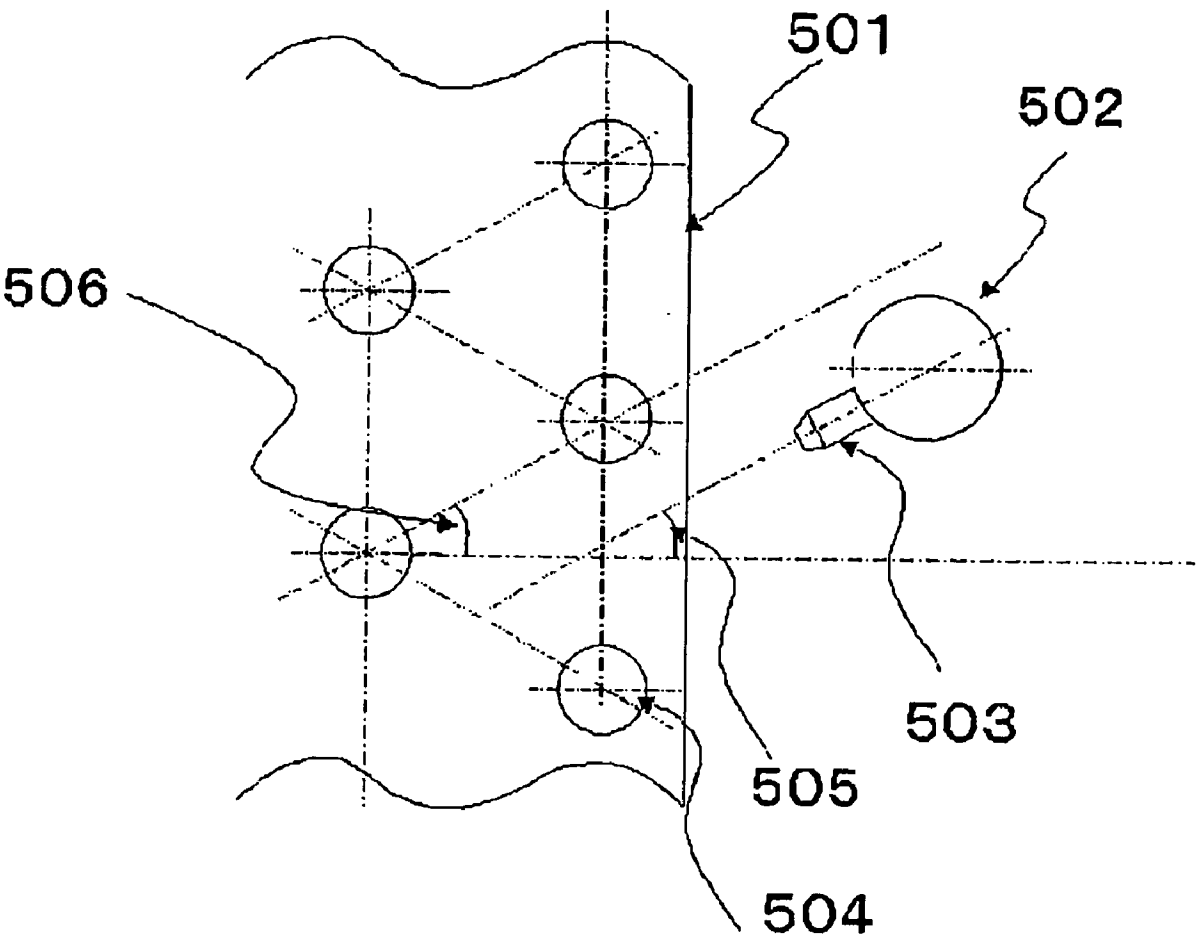
FIG. 5 is a schematic view of a part of the apparatus for cooling coil condensate water removal according to the present invention.

FIG. 5 shows the detail portion of the compressed gas pipe arrangement nozzle.

The compressed gas is sprayed from a compressed gas nozzle 503 that has passed through a compressed gas header 502. The position of each nozzle has an angle from the horizontal plane, so that the dropped condensate water flies downward forcibly. By installing the nozzle inclination angle 505 and the cooling tube 504 alignment angle 506 equally, installing the nozzle installation position avoiding the cooling fin 501, or other, the compressed gas comes to pass through between cooling fins through the tube effectively, allowing to remove condensate water with a high efficiency to the side removed nozzle. Concerning the cooling tube, as the alignment angle is normally in a range of 30 degrees to 40 degrees, it is preferable to set the nozzle angle also between 30 degrees and 40 degrees.

Figure 6:
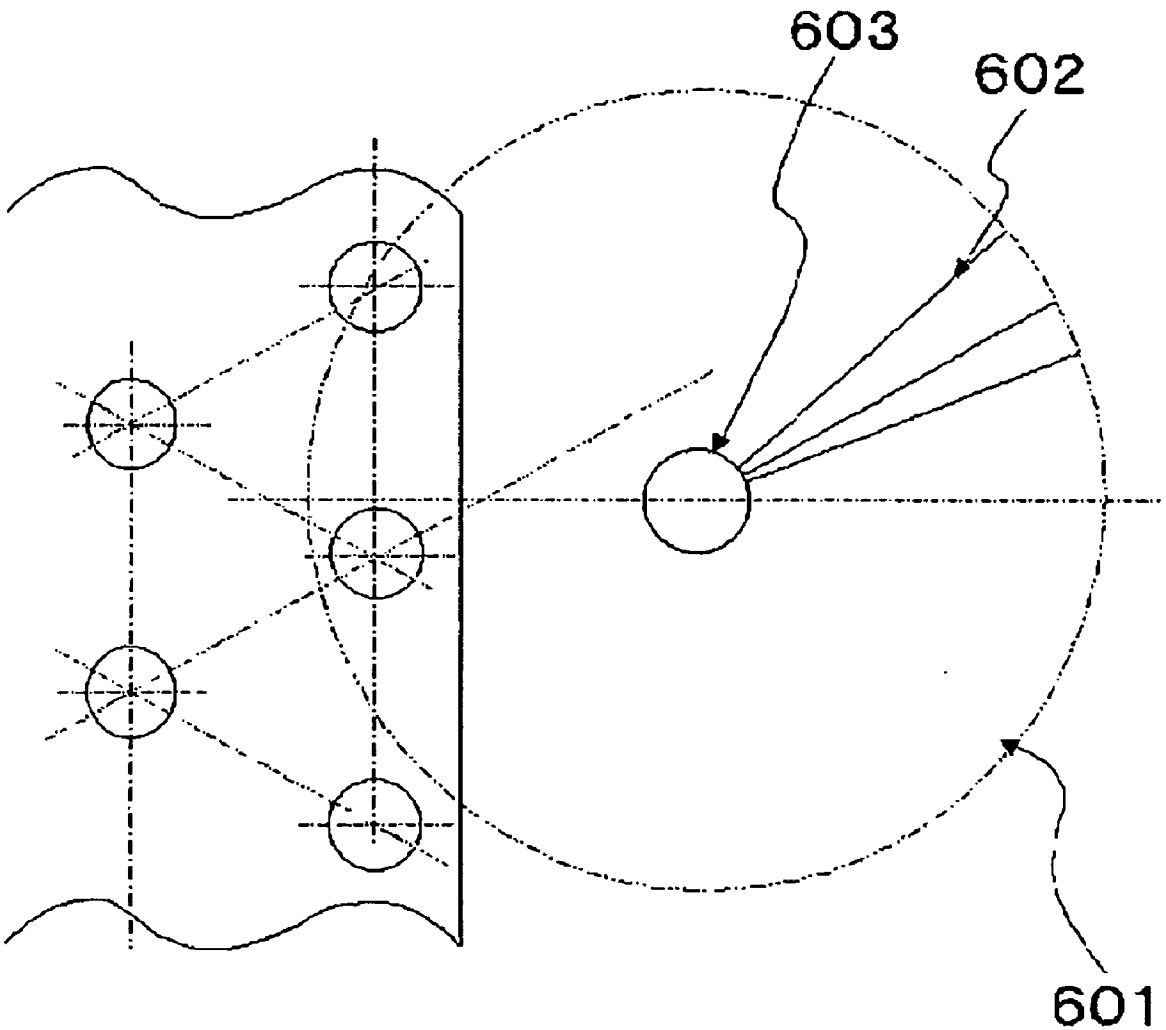
FIG. 6 is a schematic view of a part of the apparatus for cooling coil condensate water removal according to the present invention.

FIG. 6 shows a schematic view in the case of using a brush (for example, rotational brush, flat brush) in place of compressed gas nozzle. The rotational brush rotates in a range of 601, and a brush 602 made of resin and fixed to a rotation shaft 603 removes condensate water deposited on the cooling tube and fin.

Besides, it is preferable that the rotation brushes are provided in plurality, and allowed to move between heat exchangers 604 divided into one line or two lines.

In addition, in the case of using a flat brush, it is preferable that the shape of the flat brush is formed into the shape of one end 605 or both ends 606 and composed to permit moving between heat exchanges divided into one line or two lines, or moving inside slits of several stages placed every line or two lines of heat exchangers 607 of a continuous number of lines.

On the other hand, it is effective to use a deaeration water as cooling water to circulate in the cooling water tube of the cooling coil, in order to increase the conversion efficiency. Here, the deaeration water means a city water removed gases (especially oxygen) from the city water. The oxygen concentration in the deaeration water is preferably equal or inferior to 10 ppm, more preferably equal or inferior to 5 ppm and still more preferably equal or inferior to 3 ppm. Nevertheless, as the effect saturates under than 1 ppm, 1 to 10 ppm is a preferable range.

Also, it is preferable to use hydrogen water as cooling water for circulation in the cooling water tube of the cooling coil. Hydrogen water is a hydrogenated water, and it is further preferable to use a water wherein the deaeration water is hydrogenated. The hydrogen concentration in the hydrogen water is preferably 0.5 to 1.5 ppm.

EMBODIMENTS

Hereinbelow, results of removal of condensate water deposited on the cooling coil 304 or 407 of an air-conditioner, by the apparatus of the present invention.

(Embodiment 1)

The cooling coil was supplied with a cooling water of 7° C. and the cooling water temperature was measured at the cooling water exit.

As parameter of that time, experiments were performed for a case where condensate water deposits on the coil, a case of removing condensate water with compressed gas using the apparatus shown in FIG. 1, a case of applying the coil surface treatment, and a case of using deaeration water, hydrogen water as cooling water, and they were compared each other.

Keep cooling water supply conditions and intake gas temperature constant, and measure gas output temperature and cooling water output temperature. The gas output temperatures in the case of operating the condensate water removal apparatus, in the case of not operating, and in the case of not processing were compared.

Figure 7:
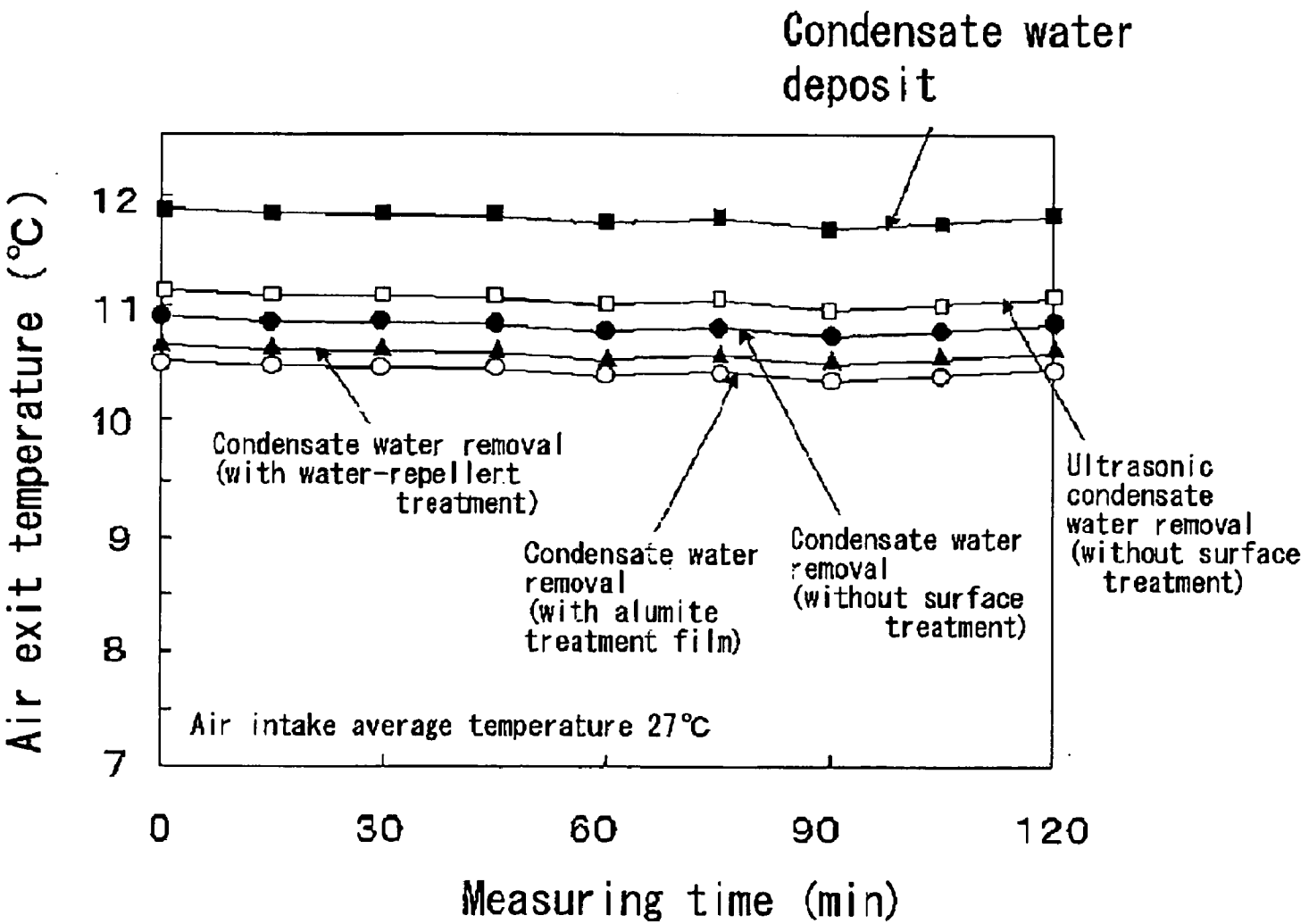
FIG. 7 is a diagram showing experimental results according to the present invention.

It should be appreciated that the experiment is performed under the condition of simultaneity, in order to impose the same condition to the intake gas temperature. FIG. 7 shows measurement results of gas output temperature.

In FIG. 7, ● shows results of the example and ■ results of a comparison example.

It was confirmed that the removed heat quantity by coil is more effective in the case of removing condensate water than the case without removal, because the gas exit temperature in the case of removing condensate water (●) is lower than the case without removal (■).

(Embodiment 2)

The comparison was performed between the one where PFA film of water-repellent fluorine base resin is applied to the outer surface of the cooling coil and a case without film.

Removal of condensate water was performed by compressed gas similarly to the Embodiment 1.

It should be appreciated that the thickness of PFA film is preferably about 0.5 to 1.0 mm. Adopting such thickness, the thermal efficiency degradation due to film can be limited to the minimum, and at the same time, condensate water is prevented from depositing, and the removal of deposited condensate water can be facilitated.

By the experiment of the time, the condensate water removal apparatus was operated. It was confirmed that it is more effective in the case of applying a surface treatment than the case without surface treatment, because the gas exit temperature in the case of applying the surface treatment by film of water-repellent resin (FIG. 7Δ) is lower than that in the case without application (FIG. 7▲) thereof.

(Embodiment 3)

In the example, the comparison was performed between the one where alumite treatment is applied to the outer surface of the cooling coil and a case without film.

Removal of condensate water was performed by compressed gas similarly to the Embodiment 1.

In the experiment of this time, the condensate water removal apparatus was operated. It was confirmed that it is more effective in the case of applying a surface treatment such as alumite treatment than the case without surface treatment, because the gas exit temperature in the case of applying a surface treatment by alumite treatment (FIG. 7○) is lower than that in the case without application (FIG. 7■).

(Embodiment 4)

The comparison was performed between a case where ultrasonic waves are applied to the cooling coil and a case without application.

In the experiment of this time, the condensate water removal apparatus was operated. An ultrasonic element is fixed to a cooling coil plate portion 206 and, furthermore, connected and fixed to the ultrasonic element and a frame section of the apparatus for gas temperature and humidity adjustment. Condensate water deposited on the cooling coil is removed by oscillating the cooling coil main body through the vibration of the ultrasonic element. The frequency of the ultrasonic waves to be used is set to 20 to 50 kHz. This is because under 20 kHz the sound wave energy is insufficient, and, over 50 kHz, there is every possibility of reducing considerably the life of the ultrasonic element.

It was confirmed that it is more effective in the case of applying ultrasonic waves than the case without application treatment thereof, because the gas exit temperature in the case of applying vibration to the cooling coil by ultrasonic waves (FIG. 7 □) is lower than that in the case without application (FIG. 7■).

(Embodiment 5)

By using deaeration water, scale is prevented from generating in the cooling water tube, and the conversion efficiency is prevented from depredating by scale generation.

The comparison was performed between a case where city water is used as cooling water to circulate in the cooling coil and a case of using deaeration water.

As deaeration water, oily water removed oxygen was used. The oxygen concentration after deaeration is 3 ppm.

Figure 8:
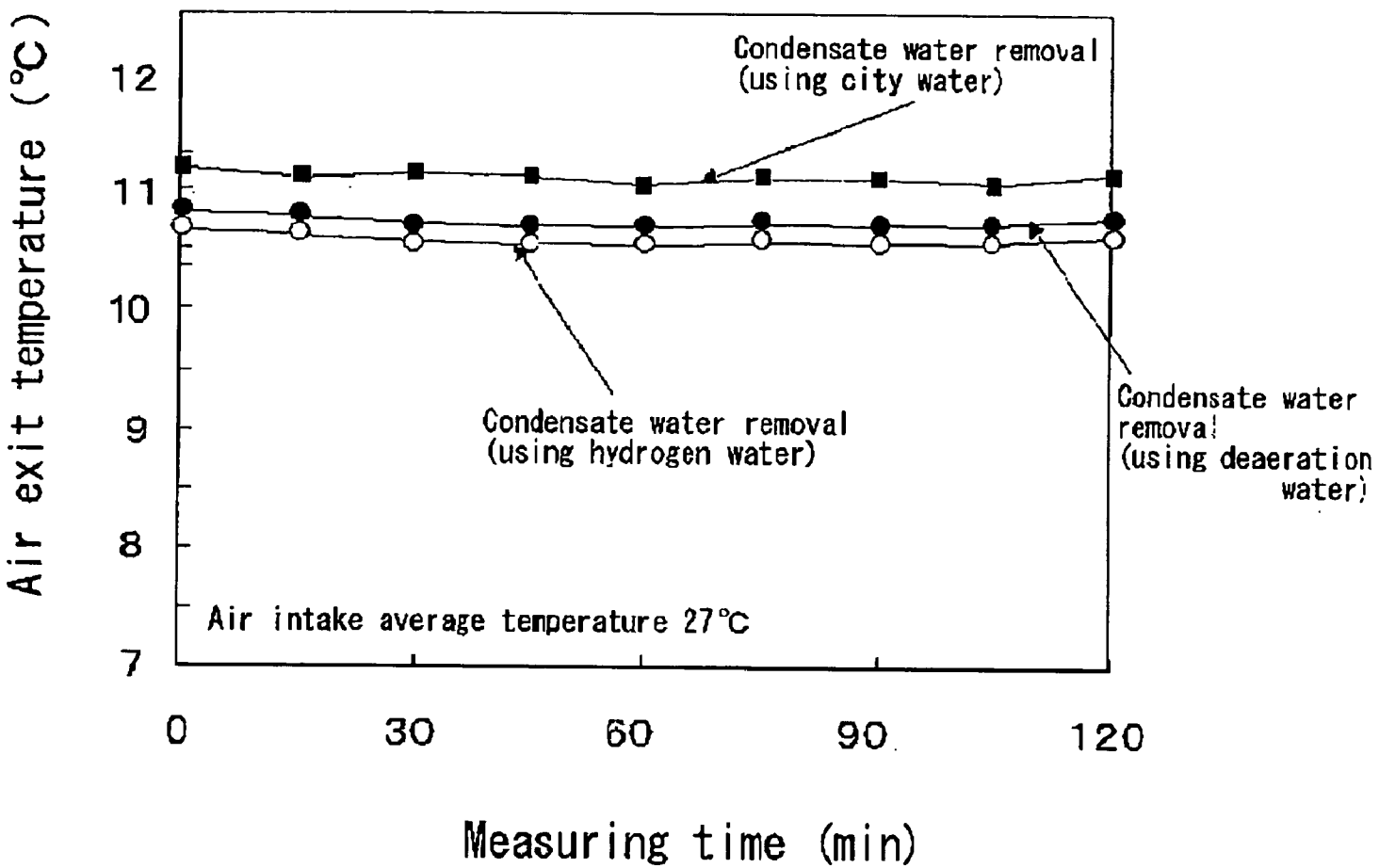
FIG. 8 is a diagram showing experimental results according to the present invention.

Test results are shown in FIG. 8. In the experiment of this time, the condensate water removal apparatus was operated. The measurement was performed after letting cooling water flow through the cooling coil for 2000 hours continuously.

It was confirmed that it is more effective in the case of using deaeration water than that in the case of using city water, because the gas exit temperature in the case of letting flow the deaeration water (FIG. 8●) is lower than the case of city water (FIG. 8■).

It should be appreciated that, in the case also of not removing condensate water, results demonstrating that the exit temperature is lower in the case of using deaeration water than the case of using city water were also obtained.

It should be appreciated that particularly good results were obtained not more than 10 ppm when the experiment was carried out by changing the oxygen concentration in a range of 0.5 to 20 ppm.

(Embodiment 6)

By using hydrogen water, scale is prevented from generating in the cooling water tube, and the conversion efficiency is prevented from depredating by scale generation.

The comparison was performed between a case where city water is used as cooling water to circulate in the cooling coil and a case of using hydrogen water.

As hydrogen water, city water removed oxygen and thereafter hydrogenated was used. The hydrogen concentration after hydrogenation is 0.6 ppm.

Test results are shown in FIG. 8.

In the experiment of this time, the condensate water removal apparatus was operated. The measurement was performed after letting cooling water flow through the cooling coil for 2000 hours continuously.

It was confirmed that it is more effective in the case of letting flow hydrogen water than the case of using city water, because the gas exit temperature in the case of letting flow the hydrogen water (FIG. 8○) is lower than that In the case of city water (FIG. 8■).

It should be appreciated that, a similar trend was also obtained in the case of not removing condensate water.

INDUSTRIAL APPLICABILITY

According to the present invention, the heat exchange efficiency of the cooling coil elevates, the cooling water quantity can be reduced, the pipe arrangement diameter and water supply pump power also can be lowered, making possible to cut the initial cost and running cost of the air-conditioning system.

What is claimed is:

1. An apparatus for high efficiency gas temperature and humidity adjustment, comprising:

a cooling coil; and a water removal member coupled to said apparatus for physically and forcibly removing condensate water depositing on said cooling coil during operation of said apparatus.

2. An apparatus for high efficiency gas temperature and humidity adjustment, comprising:

a cooling coil; and a means for supplying the cooling coil with at least one of deaeration water and hydrogen water as cooling water.

3. An apparatus for high efficiency gas temperature and humidity adjustment, comprising:

a cooling coil; and a condensate water removal means for removing condensate water deposited on said cooling coil, said condensate water removal means being a means for spraying compressed gas to said cooling coil.

4. The apparatus for high efficiency gas temperature and humidity adjustment of claim 3, wherein the pressure of said compressed gas is 2 to 10 kgf/cm$^2$.

5. The apparatus for high efficiency gas temperature and humidity adjustment of claim 3, wherein said compressed gas is a cooling gas.

6. An apparatus for high efficiency gas temperature and humidity adjustment, comprising:

a cooling coil; and a condensate water removal means for removing condensate water deposited on said cooling coil, said condensate water removal means coming physically into contact with the condensate water and having a function to remove the condensate water.

7. The apparatus for high efficiency gas temperature and humidity adjustment of claim 6, wherein said condensate water removal means is a brush.

8. The apparatus for high efficiency gas temperature and humidity adjustment of claim 7, wherein said brush is composed to be capable of removing said condensate water by rotation or other displacement.

9. An apparatus for high efficiency gas temperature and humidity adjustment, comprising:

a cooling coil, said cooling coil having cooling fins thereon, said cooling fins of said cooling coil being divided every one line or two lines or having slits for displacement guides disposed every one line or two lines of heat exchange fins; and a condensate water removal means for removing condensate water deposited on said cooling coil.

10. An apparatus for high efficiency gas temperature and humidity adjustment, comprising:

a cooling coil, a surface of said cooling coil being composed of a water-repellent surface; and a condensate water removal means for removing condensate water deposited on said cooling coil.

11. The apparatus for high efficiency gas temperature and humidity adjustment of claim 1 comprising a means capable of spraying condensed liquid again.

12. An apparatus for high apparatus for high efficiency gas temperature and humidity adjustment, comprising:

a cooling coil, a surface treatment using alumite treatment film being applied to the surface of said cooling coil so that the heat transfer efficiency from the surface thereof to a gas by heat radiation can be improved; and a condensate water removal means for removing condensate water deposited on said cooling coil.

13. An apparatus for high efficiency gas temperature and humidity adjustment, comprising:

a cooling coil, an ultrasonic applying apparatus for applying vibration by ultrasonic waves being comprised on the surface of said cooling coil; and a condensate water removal means for removing condensate water deposited on said cooling coil.

14. An apparatus of high efficiency gas temperature and humidity adjustment, comprising:

a cooling coil, a means for supplying a cooling water tube of said cooling coil with deaeration water; and a condensate water removal means for removing condensate water deposited on said cooling coil.

15. An apparatus for high efficiency gas temperature and humidity adjustment, comprising:

a cooling coil, a means for supplying a cooling water tube of said cooling coil with hydrogen water; and a condensate water removal means for removing condensate water deposited on said cooling coil.

16. A method for high efficiency gas temperature and humidity adjustment, the method comprising the steps of:

letting flow cooling water in a cooling water tube of a cooling coil; and cooling a gas to be cooled by letting flow the gas to be cooled between cooling fins, wherein deaerated water is used as coil cooling water.

17. An apparatus for high efficiency gas temperature and humidity adjustment, comprising:

a cooling coil; and a condensate water removal means for at least one of promoting and enhancing removal of condensate water deposited on said cooling coil, said condensate water removal means comprising a surface treatment of said heating coil, said surface treatment at least one of causing the surface of said cooling coil to be water repellent and improving the heat transfer efficiency of the surface of said cooling coil.

* * * * *